United States Patent [19]

Curtis et al.

[11] 4,411,229

[45] Oct. 25, 1983

[54] CYLINDER DEACTIVATION DEVICE

[75] Inventors: Nikolaus A. Curtis, Yuma; James E. Karner, Tucson, both of Ariz.

[73] Assignee: Mile-Age Research Corporation, Yuma, Ariz.

[21] Appl. No.: 232,877

[22] Filed: Feb. 9, 1981

[51] Int. Cl.[3] ..... F02D 13/06

[52] U.S. Cl. ..... 123/198 F; 123/90.16; 123/90.43

[58] Field of Search ..... 123/198 F, 90.16, 90.15, 123/90.41, 90.43

[56] References Cited

U.S. PATENT DOCUMENTS

| | | | |
|---|---|---|---|
| 4,141,333 | 2/1979 | Gilbert | 123/198 F |
| 4,221,200 | 9/1980 | Soefers | 123/198 F |
| 4,222,354 | 9/1980 | Uitvlugt | 123/198 F |
| 4,230,076 | 10/1980 | Mueller | 123/198 F |
| 4,249,488 | 2/1981 | Siegla | 123/198 F |
| 4,337,738 | 7/1982 | Bubniak et al. | 123/198 F |

*Primary Examiner*—Ira S. Lazarus

*Attorney, Agent, or Firm*—Cahill, Sutton & Thomas

[57] ABSTRACT

A cylinder deactivation device includes a stud rigidly engaged with the head of an internal combustion engine, a rocker arm, a rocker ball, a stand element attached to the upper end of the stud, a cylindrical sleeve having an interior ridge in the inner wall thereof, and a compression spring for exerting a constant force urging the rocker ball against the rocker arm. The stand element has a longitudinal hole and a plurality of transverse holes which extend to the longitudinal hole and a plurality of steel balls which move outward in the respective transverse holes in response to insertion of a tapered plunger into the longitudinal hole to engage the internal ridge and prevent upward movement of the sleeve. The rocker ball engages the bottom of the sleeve, and acts as a fulcrum for the rocker arm when the tapered plunger is fully inserted. When the plunger is retracted, the steel balls recede and do not engage the interior ridge, allowing the rocker ball and the sleeve to yield to the rocker arm.

3 Claims, 3 Drawing Figures

CYLINDER DEACTIVATION DEVICE

BACKGROUND OF THE INVENTION

1. Field of the Invention:

The invention relates to devices for selectively deactivating cylinders of internal combustion engines to improve operating economy under low-load operating conditions.

2. Description of the Prior Art:

A number of systems for selectively deactivating cylinders of internal combustion engines have been proposed. One such system is disclosed in U.S. Pat. No. 4,168,449, wherein a hydraulically actuated device attached to a stud extending from the head of the engine engages a rocker ball about which the rocker arm pivots during normal engine operation. The normal fulcrum point for the rocker arm is maintained when the hydraulic device is actuated. The hydraulic device includes a piston which forces three rods against the sleeve, the lower end of which engages the rocker ball. When the hydraulic pressure is released, the rocker ball is no longer maintained in fixed relationship to the stud, so that when the push rod forces one end of the rocker arm upward, the rocker ball yields to the rocker arm and does not act as a fulcrum therefore. This prevents the corresponding valve from opening. The device disclosed in U.S. Pat. No. 4,169,449 has numerous shortcomings, one of the most serious of which is that when the engine is operating, there is little or no downward pressure continuously exerted on the push rods for "deactivated" cylinders, while there is a very large downward pressure exerted on by the push rod end of the rocker arms for "activated" or normally operating cylinders (due to the forces exerted on the opposite ends of the rocker arms by the valve springs of open valves). This imbalance results in "lash" or shock in the timing gears and timing belts that drive the camshaft of the engine. Such shock causes excessively loud engine operating noise, especially in engines which are somewhat worn (due to use). Further, the imbalance and resulting lash or shock substantially decreases the normal life expectancy of timing gears and timing belts causing unexpected failures.

Accordingly, it is an object of the invention to provide a cylinder deactivation system which does not produce substantially increased noise in an operating engine.

It is another object of the invention to provide a cylinder deactivation system which does not result in excessive wear of timing gears or timing belt components in an internal combustion engine.

The above mentioned three rods which engage the hydraulic piston in the above mentioned cylinder deactivation system experience an undue amount of wear. Furthermore, fitting of the system described in U.S. Pat. No. 4,169,449 usually requires "tapping into" the hydraulic system which operates the power steering unit of an automobile, increasing the likelihood of a leak in that system and loss of power steering due to leakage or other malfunction. If the above described cylinder deactivation device is to be retrofitted to an automobile which does not have power steering, a hydraulic fluid pump must be installed, greatly increasing the expense of providing the deactivation system on that automobile. Furthermore, the deactivation system disclosed in U.S. Pat. No. 4,169,449 causes the deactivatable cylinders to be deactivated when the engine is not running because the hydraulic pressure does not exist when the engine is off. This means that only the non-deactivatable cylinders can fire during starting of the engine, so engine using the system of U.S. Pat. No. 4,169,449 experience difficult starting. Furthermore, if the engine has a tendency to "diesel" when the engine is turned off, this tendency becomes more pronounced, due to the loss of hydraulic pressure that deactivates some of the cylinder thereby reducing the amount of "drag" on the dieseling cylinders.

Accordingly, it is another object of the invention to provide a cylinder deactivation system which does not require a hydraulic fluid pump.

The cylinder deactivation system disclosed in U.S. Pat. No. 4,169,499 is unduly complex in that it requires a large number of high precision, expensive components. The complex design results in unduly low reliability and high cost.

Therefore, it is another object of the invention to provide a cylinder deactivation system that requires relatively few components and is inexpensive to manufacture and install in an automobile engine.

A number of other cylinder deactivation systems, including those disclosed in U.S. Pat. Nos. 4,204,512; 4,096,845; 4,141,333; 4,114,588; 4,187,824; and 4,161,938 all have various serious disadvantages which make them unduly expensive, unreliable, and unsuitable for being retrofitted to most previously manufactured automobile engines.

Another cylinder deactivation system, which is available on 1981 Cadillac automobiles, includes an assembly having a solenoid and two movable fulcrum members which rest against rocker pivots. The device is attached to the cylinder head by means of two bolts which respectively pass through the two respective movable fulcrum members, rocker pivots and rocker arms. Compression springs inside each of the movable fulcrum members engage a plate from which four pegs extend upwardly. A slotted disc is rotatably disposed at the upper end of each of the two cylindrical fulcrum members. If the disc is aligned with the pegs, the pegs pass through the slots of the disc, allowing the fulcrum member and rocker pivot to yield to the rocker arm as it is lifted by a push rod, thereby preventing the rocker arm from opening a valve. However, if the pegs and the slots in the disc are not aligned, the movable fulcrum member maintains the rocker pivot in a fixed position, so that when the push rod is raised, the rocker arm pivots about the rocker pivot, causing a valve of the engine to open. The foregoing device is not suitable for adaptation to other types of previously manufactured engines because it is completely unadjustable, so that cannot be installed on engines having normal studs. Furthermore, when the subject cylinder is activated, the pegs "hammer" against the rotating discs each time the corresponding push rod is raised. It would appear that this hammering would result in undue engine wear and engine noise.

It is therefore another object of the invention to provide an improved, low cost, highly reliable cylinder deactivation system which avoids the shortcomings of the prior art.

SUMMARY OF THE INVENTION

Briefly described, and in accordance with one embodiment thereof, the invention provides a cylinder deactivation device for installation on internal combustion engines. The cylinder deactivation device includes a rocker arm having first and second end portions and a mid portion, a stud mounted in fixed relationship to the head of the engine for supporting the cylinder deactivation device, a selectively movable fulcrum which either assumes a fixed relationship relative to the stud, causing the rocker arm to pivot about the movable fulcrum in a normal manner if the corresponding cylinder is activated, or yielding to movement of the mid portion of the rocker arm, preventing the rocker arm from opening a valve of the engine, if the cylinder is deactivated. In the described embodiment of the invention, a compression spring continually exerts a sufficient amount of force against the movable fulcrum, and hence against the mid portion of the rocker arm, to eliminate noise and wear due to imbalance of counterforces on the push rod of activated and deactivated cylinders during engine operation. The movable fulcrum includes a rocker ball and a cylindrical sleeve having an interior ridge therein. A fixed stand member attached to the upper end of the stud has a plurality of transverse holes therein, each accommodating a steel ball. A tapered plunger, actuated by a linear solenoid, extends into a longitudinal hole in the stand element and forces the steel balls outward so that they engage the interior ridge when the cylindrical sleeve assumes a relatively lowered position and maintains the cylindrical sleeve in the lowered position until the tapered plunger is partially retracted, thereby maintaining the cylindrical sleeve, and hence the rocker ball in a fixed lowered position. This causes the rocker ball to function as a fulcrum for the rocker arm when the corresponding cylinder is operating in a normal or activated mode. When the tapered plunger is partially retracted, the steel balls recede into the transverse holes and do not engage the interior ridge. The sleeve then yields to allow movement of the rocker ball and midportion of the rocker arm whereby the rocker arm pivots about its valve end, and therefore does not open the valve of the cylinder when the cylinder is deactivated.

A BRIEF DESCRIPTION OF DRAWINGS

DESCRIPTION OF THE INVENTION

This invention is related to my co-pending application, "CYLINDER DEACTIVATION DEVICE WITH SLOTTED SLEEVE MECHANISM", filed on even date herewith, and incorporated herein by reference.

Figure 1:
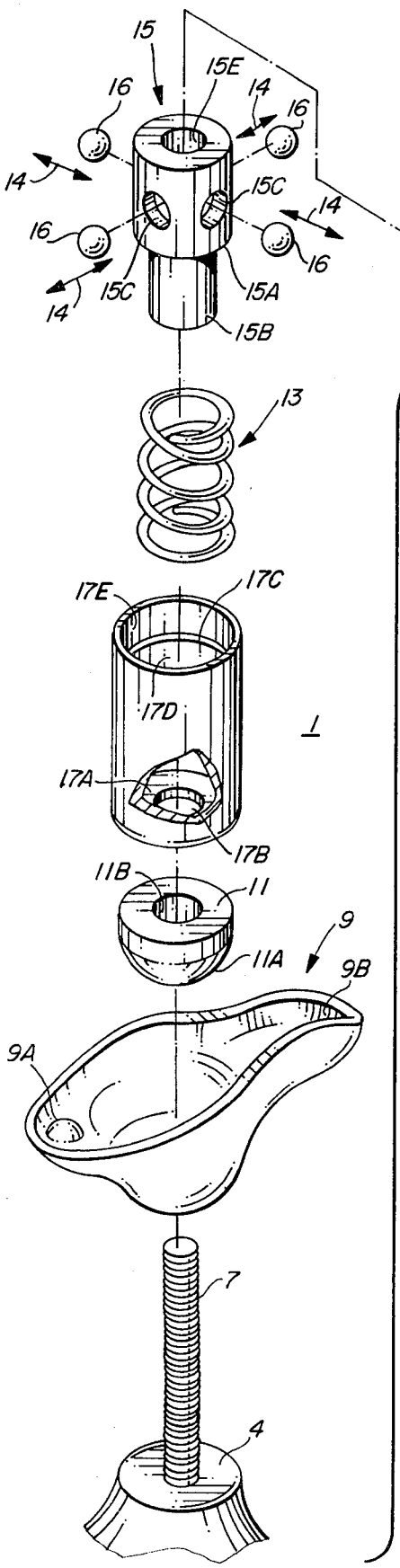
FIG. 1 is a partially exploded perspective view of an embodiment of the invention.
Figure 2A:
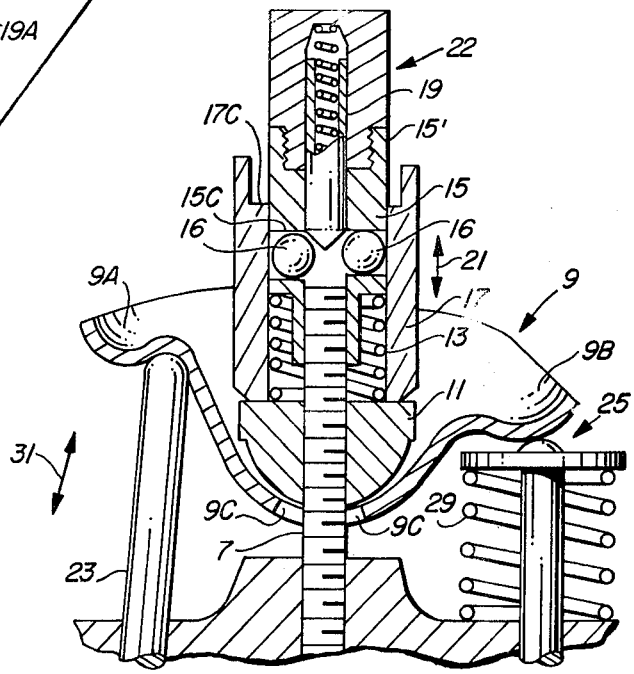
FIG. 2A is a partial sectional view useful in explaining the operation of the embodiment of the invention shown in FIG. 1.

Referring now to FIG. 1, reference numeral 4 designates a portion of a cylinder head, reference numeral 1 designates a cylinder deactivation assembly and reference numeral 7 represents a partially threaded stud extending upward from cylinder head 4. Cylinder deactivation assembly 1 includes rocker arm 9, which has a hole 9C (shown in FIG. 2A) in the lower portion thereof through which stud 7 extends. Rocker arm 9 has a push rod end 9A for engagement with a push rod 23 (shown in FIG. 2A) and a valve end 9B for engagement with a valve 25 (a portion of which is shown in FIG. 2A). Rocker arm 9 has an inner cavity with a concave surface which engages rounded surface 11A of a conventional rocker ball 11. Rocker ball 11 has a hole 11B through which stud 7 extends.

Cylinder deactivation assembly 1 further includes cylindrical sleeve 17. Sleeve 17 has an open upper end having a cylindrical inner wall 17E. An annular ridge 17C separates wall 17E from lower cylindrical wall 17D. Note that in the described embodiment of the invention the lower portion of sleeve 17 has a smaller interior diameter than the upper portion, thereby forming annular ridge 17C. A bottom flange 17A has a circular hole 17B therein through which stud 7 extends.

Compression spring 13 fits within the lower portion of sleeve 17, the lower portion of compression spring 13 being retained by bottom flange 17A. The upper end of compression spring 13 is retained by ridge 15A between lower cylindrical portion 15B and upper cylindrical portion 15D of a stand element 15. An axial hole 15E extends through stand element 15, the upper portion of hole 15E being unthreaded, the lower portion being threaded for engaging the upper threaded portion of stud 7. A set screw (not shown) is screwed into the upper part of the threaded portion of hole 17B to facilitate installation of assembly one onto stud 7 by abutting the upper end of stud 7, thereby locking the position of stand element 15 relative to stud 7.

Four circular transverse holes 15C are formed in the upper portion of stand element 15, each of transverse holes 15C extending through the wall of upper portion 15D to axial hole 15B.

Four circular steel balls 16 are movable in each of holes 15C in the direction indicated by arrows 14, as subsequently explained.

A steel plunger 19 having a tapered lower end 19A slideably fits into hole 15E. Plunger 19 is the movable element of a linear solenoid, which can be implemented by means of a linear solenoid 22 (FIG. 2A) which can be a No. 174610-081 solenoid by LEDEX, Inc. of Dayton, Ohio.

Referring now to FIG. 2A, it is seen that the upper portion of stand element 15 has a threaded flange 15' (omitted for convenience in FIG. 1). The lower portion of the body of linear solenoid 22 has a threaded collar which engages the threads of flange 15' of stand element 15.

The operation of cylinder deactivation assembly 1 when the corresponding cylinder of the engine is deactivated now will be explained with reference to FIG. 2A. When the subject cylinder is deactivated, solenoid plunger 19 is maintained in its highest position by linear solenoid 22, so that the lower tapered end 19A of plunger 19 is positioned above steel balls 16. Note that Solenoid 22 is actuated or energized when plunger 19 is in its highest position. This allows steel balls 16 to move inward in transverse holes 15C, thereby allowing sleeve 17 to slide upward along stand element 15 as push rod 23 moves upward. With steel balls 16 pushed inward as far as possible in transverse holes 15C, ridge 17C of sleeve 17 does not engage portions of balls 16 because they have been allowed to recede into holes 15C. Note that the inner portions of transverse holes 15C are slightly tapered to prevent balls 16 from falling into hole 15B. It can be seen that with balls 16 receded into transverse holes 15C, rocker ball 11 is raised and lowered as push rod 23 is raised and lowered. Sleeve 17 also is correspondingly raised and lowered in the directions indicated by arrow 21. Thus, when steel balls 16 are receded in transverse holes 15C, rocker ball 11 yields to movement of the midsection of rocker arm 9 and does not function as a fulcrum for rocker arm 9. Rocker arm 9 therefor pivots about end 9B. Thus, as push rod 23 continues to move up and down in the directions indicated by arrow 31, sleeve 21 correspondingly moves up and down and the directions indicated by arrows 21 as long as steel balls 16 are receded into holes 15C. Compression spring 13, which is far weaker than valve spring 29, compresses and expands accordingly. As explained in detail in my above mentioned co-pending application, incorporated herein by reference, compression spring 13 exerts a force of approximately 39 pounds downward on the bottom flange 17A of sleeve 17, maintaining sufficient downward force on rocker ball 11 and rocker arm 9 that deleterious timing gear and timing chain shock and "lash" are avoided when cylinders of the engine are deactivated.

Figure 2B:
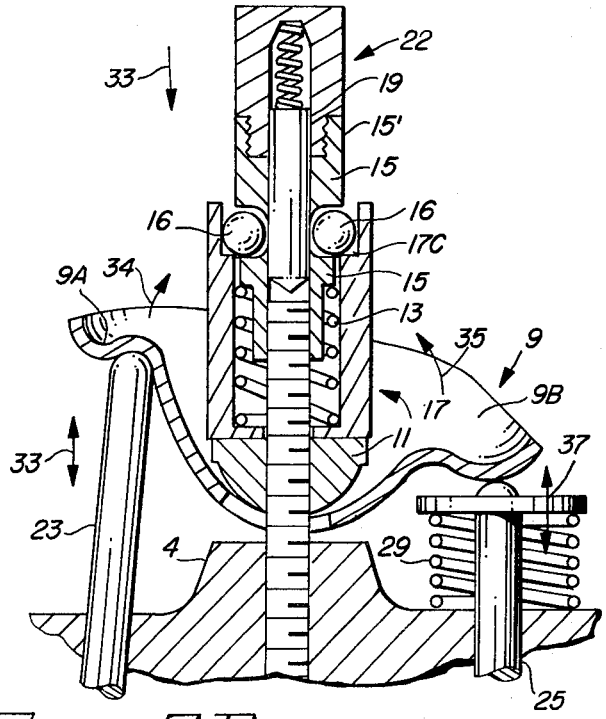
FIG. 2B is another partial sectional view useful in explaining the operation of the embodiment of the invention shown in FIG. 1.

It can be seen that if solenoid 22 is "unactuated" plunger 19 is forced downward by spring 22C, which is disposed in the hollow interior of plunger 1A, and produces opposed faces against cavity 22A of the solenoid body and plunger 1A. This occurs if the cylinder is operating in the actuated mode. Its tapered end portion 19A therefore exerts an outward force on steel balls 16. As soon as push rod 23 is lowered to the point that ridge 17C of sleeve 17 is below transverse hole 15C, plunger 19 forces steel balls 16 outward against the upper interior wall 17E of stand element 17. Plunger 19 then assumes the configuration shown in FIG. 2B, and maintains steel balls 16 in "extended" locations relative to transverse holes 15C. When push rod 23 again moves upward, ridge 17C engages protruding steel balls 16. Therefore, sleeve 17 can not rise in response to upward force applied to sleeve 17 by rocker ball 11. Rocker ball 11 therefore acts as a fulcrum for rocker arm 9. Rocker arm 9 then pivots in the directions indicated by arrows 34 and 35 as push rod 23 reciprocates in the directions indicated by arrow 33, and valve 25 opens and closes in the normal manner as indicated by arrow 37.

While the invention has been described with reference to a particular embodiment thereof, those skilled in the art will be able to make various modifications to the described reembodiment of the invention without departing from the true spirit and scope of the invention. Various alternate elements could be utilized in lieu of steel balls 16. For example, laterally slideable elements having tapered surfaces for engaging the tapered end of plunger 19 and for engaging ridge 17C could be provided. Ridge 17C can be shaped to provide relatively uniform contact between the sliding elements and the sloped surfaces thereof. Instead of using the disclosed plunger and linear solenoid, a rotary cam could be disposed in hole 15E and a rotary solenoid device or the equivalent thereof could be used to effect outward urging of balls 16.

We claim:

1. A cylinder deactivation device for installation in an internal combustion engine, said device comprising in combination:

(a) a rocker arm having an end portion for engaging a valve and a mid portion pivotal about a rocker ball;

(b) a stud rigidly attached in fixed relation to a cylinder head of said engine and extending through a hole in said rocker ball, said stud having a threaded upper end portion;

(c) a cylindrical stand element having a lower threaded opening tightly threaded onto said upper end portion of said stud, said stand element having a plurality of cylindrical lateral openings, and an upper opening extending from the top of said stand element to the inner end portions of said lateral openings;

(d) a sleeve element slidably disposed about said stand element and having a lower end portion engaging said rocker ball, said sleeve element also having an inner recess alignable with said lateral openings;

(e) a compression spring in said sleeve element having an upper end engaging said stand element and a lower end urging said sleeve element against said rocker ball;

(f) a plurality of balls disposed in said plurality of lateral openings, respectively;

(g) a plunger element disposed in said upper hole and movable to a lower position when said recess is aligned with said lateral openings to force said balls partially into said recess to lock said sleeve element in fixed relation to said stand element, said plunger element also being movable to an upper position which allows said balls to slide inward in said lateral holes to allow said sleeve element to slide freely over the outer surface of said stand element;

(h) a solenoid rigidly attached to the upper end portion of said stand element, said plunger element being incorporated into said solenoid whereby said rocker ball provides a fixed pivot for said rocker arm when said plunger is in said lower position and yields to said rocker arm when said plunger is in said upper position.

2. The cylinder deactivation device of claim 1 wherein said plunger has a tapered surface to effect forcing of said balls to move partially into said recess when said solenoid urges said plunger into said lower position.

3. A cylinder deactivation device for installation in an internal combustion engine, said device comprising in combination:

(a) a rocker arm having an end portion for engaging a valve and a mid portion pivotal about a rocker ball;

(b) a stud rigidly attached in fixed relation to a cylinder head of said engine and extending through a hole in said rocker ball, said stud having a threaded upper end portion;

(c) a cylindrical stand element having a lower threaded opening tightly threaded onto said upper end portion of said stud, said stand element having a plurality of lateral openings, and an upper opening extending from the top of said stand element to the inner end portions of said lateral openings;

(d) a sleeve element slidably disposed about said stand element and having a lower end portion engaging said rocker ball, said sleeve element also having an inner recess alignable with said lateral openings;

(e) a compression spring in said sleeve element having an upper end engaging said stand element and a lower end urging said sleeve element against said rocker ball;

(f) a plurality of recess-engaging elements disposed in said plurality of lateral openings, respectively;

(g) a control element disposed in said upper hole and movable to a first position when said recess is aligned with said lateral openings to force said recess-opening elements partially into said recess to lock said sleeve element in fixed relation to said stand element, said control element also being movable to a second position which allows said recess-engaging elements to slide inward in said lateral holes to allow said sleeve element to slide freely over the outer surface of said stand element, whereby said rocker ball provides a fixed pivot for said rocker arm when said control element is in said first position and yields to said rocker arm when said plunger element is in second position.

* * * * *